US006744409B2

(12) United States Patent
Ellis et al.

(10) Patent No.: US 6,744,409 B2
(45) Date of Patent: Jun. 1, 2004

(54) HIGH EFFICIENCY TRANSMIT ANTENNA

(75) Inventors: Grant Andrew Ellis, Seattle, WA (US); Saxon Sean Ian Liw, Singapore (SG)

(73) Assignee: National University of Singapore, Singapore (SG)

( * ) Notice: Subject to any disclaimer, the term of this patent is extended or adjusted under 35 U.S.C. 154(b) by 39 days.

(21) Appl. No.: 10/029,234

(22) Filed: Dec. 28, 2001

(65) Prior Publication Data

US 2003/0122716 A1 Jul. 3, 2003

(51) Int. Cl.[7] ..... H01Q 1/38

(52) U.S. Cl. ..... 343/700 MS; 343/702; 343/847

(58) Field of Search ..... 343/700 MS, 702, 343/829, 846, 848

(56) References Cited

U.S. PATENT DOCUMENTS

| | | | | |
|---|---|---|---|---|
| 4,328,501 A | * | 5/1982 | DeSantis et al. | 343/749 |
| 6,072,434 A | * | 6/2000 | Papatheodorou | 343/700 MS |
| 6,252,553 B1 | * | 6/2001 | Solomon | 343/700 MS |
| 6,255,994 B1 | * | 7/2001 | Saito | 343/700 MS |
| 6,295,030 B1 | * | 9/2001 | Kozakai et al. | 343/700 MS |
| 6,476,769 B1 | * | 11/2002 | Lehtola | 343/702 |

OTHER PUBLICATIONS

V. Radisic; Y. Qian, T. Itoh; "Novel Architectures for High–Efficiency Amplifiers for Wireless Applications"; IEEE Transactions on Microwave Theory and Techniques, vol. 46, No. 11, Nov. 1998; pp 1901–1909.

V. Radisic, Y. Qian ; T. Itoh; "Class F Power Amplifier Integrated with Circular Sector Microstrip Antenna"; IEEE MTT–S Digest; 1997; pp 687–690.

W.R. Deal; V. Radisic; Y. Qian; T. Itoh; "Integrated–Antenna Push–Pull Power Amplifiers"; IEEE Transactions on Microwave Theory and Techniques, vol. 47; No. 8; Aug. 1999; pp 1418–1425.

C.Y. Hang; W.R. Deal; Y. Qian; T. Itoh; "High–Efficiency Push–Pull Amplifier Integrated with Quasi–Yagi Antenna"; IEEE Transactions on Microwave Theory and Techniques, vol. 49, No. 6, Jun. 2001; pp 1155–1161.

S.I. Liw; G.A. Ellis; "Active Planar Inverted–F Antenna for Wireless Applications"; MN–T16.09; 3 pages.

M.A. Jensen; Y. Rahmat–Samii; "The Electromagnetic Interaction Between Biological Tissue and Antennas on a Transceiver Handset"; IEEE; 1994; pp 367–370.

Edward A. Wolff; "Antenna Analysis" Artech House, 1988, Norwood, MA; pp 63–68.

H. Kuboyama; Y. Tanaka; K. Sato, K. Fujimoto; K. Hirasawa; "Experimental Results with Mobile Antennas Having Cross–Polarization Components in Urban and Rural Areas"; IEEE Transactions on Vehicular Technology, vol. 39, No. 2, May 1990; pp 150–160.

(List continued on next page.)

*Primary Examiner*—Shih-Chao Chen

(57) ABSTRACT

A planar inverted-F antenna (PIFA) to facilitate communications within a plurality of frequency bands is disclosed. The top plate of the PIFA is placed at a predetermined height above a ground plane and shorting pins are placed in contact between the top plate and the ground plane. The feed pin is placed a predetermined distance away from each of the shorting pins within the interior area of the top plate. The shorting pins provide the ability to tune the PIFA to achieve either class-F or inverse class-F impedances over a wide range of frequencies. Also disclosed is an offset top loaded monopole (TLM) in which the feed pin connected to the top plate is offset from the centre of the top plate to provide a desired impedance.

32 Claims, 3 Drawing Sheets

OTHER PUBLICATIONS

T. Taga; K. Hirasawa; M. Kaneishi; Analysis, Design and Measurement of Small and Low–Profile Antennas: Analysis of Planar Inverted–F Antenna; Artech House; 1992, Chapter 5; pp 161–180.

G.A. Ellis, S. Liw; Active Planar Inverted–F and top–Loaded Monopole Antennas for Wireless Applications; Dept. of Electrical and Computer Engineering; National University of Singapore, Singapore,1–38.

* cited by examiner

HIGH EFFICIENCY TRANSMIT ANTENNA

FIELD OF THE INVENTION

The present invention relates generally to radio communication systems and, in particular, to built-in active integrated antennas incorporated into portable communication devices.

BACKGROUND

Portable communication devices, such as mobile telephone handsets and pagers, are operated in an environment that is power limited. Thus it is important for these devices to be power efficient. To that effect it is well known that most of the power dissipation occurs in the power amplifier used for transmission. Furthermore there is a commercial demand to reduce the size and profile of the portable communication devices.

The power amplifier used by a portable communication device is typically connected to an antenna by a network of lumped passive electrical elements, such as capacitors, resistors and inductors. The network of lumped passive electrical elements is referred to as the output-matching network. The network is used to provide an impedance match between the power amplifier and the antenna. However, the network typically restricts the operating bandwidth of the power amplifier to a narrow band of frequencies. This restriction leads to power amplifier designs that ire inherently narrowband and specific to certain types of applications.

Therefore it would be a desirable to enable a direct connection between the power amplifier and the antenna that increases the power-added efficiency of the power amplifier, eliminates the lumped passive electrical elements and reduces the size and profile of the antenna.

The prior art describes using the active integrated antenna approach, whereby active devices, such as amplifiers and mixers, are directly connected to an antenna to minimize circuit size and increase the power-added efficiency of the active device. By adopting this approach there are a number of requirements that must be met by the design of the antenna for the resulting circuit to be operable. For example, once combined with a power amplifier, in addition to its original role as a radiating element, the antenna must also serve as a power-combiner and harmonically tuned load.

From hereinafter the antenna will be referred to as the radiating element, as now the power amplifier and radiating element together serve as an active antenna.

The typical load impedance for a power amplifier ranges between 10–25 Ω. By directly connecting the output terminal of the power amplifier to the radiating element, an output-matching network is eliminated. Thus the amplifier design is simplified because the classical 50 Ω termination, realized by a network of lumped passive electrical elements, is not required. Furthermore, since there is no longer a need for lumped passive electrical elements connected to the output of the power amplifier, chosen for specific frequencies, the power amplifier itself becomes broadband.

Although there is some mismatch loss between the power amplifier and the radiating element, it is tolerated by tuning the radiating element to provide a class-F or inverse class-F load directly to the amplifier for high-efficiency and high-power operation.

To further elaborate on the efficiency problem, a signal upon entering a power amplifier is typically free of distortion. However, due to the typically non-linear operation of a power amplifier, distortion of the signal occurs within the power amplifier. The distortion manifests itself as harmonics of the fundamental (carrier) frequency $f_0$ of the signal that can be easily identified in the frequency domain. The second ($2f_0$) and third harmonics ($3f_0$) of the fundamental frequency $f_0$ of a signal typically consume the most power of all the harmonics generated; thus, these two harmonics are of primary concern as they lead to the largest reductions in power added efficiency within the power amplifier.

However the presence of harmonic frequency components alone do not lead to the greatest reductions of the power added efficiency of a power amplifier. It is only when the harmonic voltages and currents are substantially in phase with one another within the power amplifier resulting in heat dissipation will the power added efficiency of the power amplifier suffer substantial reductions. Furthermore it should be noted that at low input power levels there is little or no harmonic energy but the efficiency is typically quite low. This is due to the fact that the energy dissipated within the power amplifier is typically quite high.

Class-F and inverse class-F load impedances can be used to provide impedance matching at the output of a power amplifier. The class-F load provides an optimum power match for the power amplifier at the operating frequency $f_0$, a short circuit at the second harmonic $2f_0$ and an open circuit at the third harmonic $3f_0$. The inverse class-F load provides an optimum power match for the power amplifier at the operating frequency $f_0$, an open circuit at the second harmonic $2f_0$ and a short circuit at the third harmonic $3f_0$. Inherently these classes of impedances provide the desired harmonic loading for a power amplifier to reduce the amount of power transferred to the transmission of the second and third harmonics, thus raising the efficiency of the power amplifier. The short circuits and open circuits for the harmonics at the load cause the voltages and currents to be reflected away from the load. By generating harmonics and then reflecting them back from the load creates a situation where the voltage and currents at the output of the power amplifier are sufficiently out of phase, such that the power dissipation is minimized by effectively minimizing the overlap of voltages and currents of the harmonics.

Among the antennas that can facilitate this type of design, the planar inverted-F antenna (PIFA) is one of the most promising. The planar inverted-F antenna can be tuned to provide both class-F and inverse class-F load impedances. The planar inverted-F antenna serving as the radiating element also provides an attractive radiation pattern that provides a null towards the user, thus reducing potential biological interaction, and has a cross polarization pattern that is desirable for the urban multipath environment.

A planar inverted-F antenna of the prior art consists of a planar radiating element, a feed pin, a ground plane and a shorting plate of narrower width than that of the shortened side of the planar radiating element, The degree of freedom used to design and tune planar inverted-F antennas is the width of the short circuit plate. As such the prior art lacks features that make it flexibly tunable. In particular, the prior art is characterized by a difficulty in utilizing the classic rectangular planar inverted-F antenna structure, having only a single narrow shorting plate, to realize class-F and inverse class-F impedances over a wide range of real input impedances.

SUMMARY OF THE INVENTION

The present invention overcomes the above-identified deficiencies in the art by providing a low-profile, scalable radiating element which enables the power amplifier to be operable at a plurality of frequency bands, thus making the power amplifier effectively broadband. Furthermore, this invention relates to the tuning of planar radiating elements that may be used to provide optimal impedance matching between a power amplifier and free space, so that the power-added efficiency of the power amplifier is substantially increased.

An aspect of the invention is to provide a symmetrical planar radiating element structure defined by at least one line of symmetry along the planar radiating element surface and a method of tuning said symmetrical planar radiating element structure to realize either a class-F or inverse class-F load impedance, such that the input terminal of the radiating element can be directly connected to the output terminal of a power amplifier via a length of transmission line.

Another aspect of this invention is to provide a structure and method of tuning a rectangular planar radiating element to realize either a class-F or inverse class-F load impedance, such that the input terminal of the radiating element can be directly connected to the output terminal of a power amplifier via a length of transmission line.

The present invention also provides a means for harmonic tuning of the output of the power amplifier, in addition to providing either class-F or inverse class-F load impedances.

More specifically, the present invention provides a structure of an active planar inverted-F antenna that makes use of two shorting pins and a feed pin to realize inverse class-F impedances and to provide harmonic tuning for a power amplifier. This invention provides a planar inverted-F antenna structure that can realize class-F and inverse class-F impedances over a wide range of real input impedances. The elements of the invention combine with classic planar inverted-F antenna structure to provide a radiating element that can be tuned to realize class-F and inverse class-F impedances over a wide range of real input impedances. The second shorting pin allows the response of the radiating element to be tuned at the second and third harmonic. The short section of transmission line allows further fine-tuning at the fundamental frequency and its harmonics.

Yet another aspect of the invention is to provide a method of tuning a planar inverted-F antenna, for either class-F or inverse class-F impedances, to provide optimal matching at a single frequency.

Yet another aspect of the present invention is to provide a method of tuning the planar inverted-F antenna to operate at different transmission frequencies once it has been optimized for a single transmission frequency.

The invention utilizes two shorting pins, instead of a single shorting plate, connected between the top plate and the ground plane to tune the radiating element to either class-F or inverse class-F impedances over a wide range of frequencies. In doing so, the present invention also provides for a radiating element with co-polarized electromagnetic field components and cross-polarized electromagnetic field components.

Another aspect of the invention is to provide a method of tuning an offset top loaded monopole, for inverse class-F impedances, to provide optimal matching at a single frequency.

Yet another aspect of the present invention is to provide a method of tuning the offset top loaded monopole to operate at different transmission frequencies once it has been optimized for a single transmission frequency.

Other aspects and features of the present invention will become apparent, to those ordinarily skilled in the art, upon review of the following description of the specific embodiments of the invention.

DESCRIPTION OF THE PREFERRED EMBODIMENTS

Figure 1A:
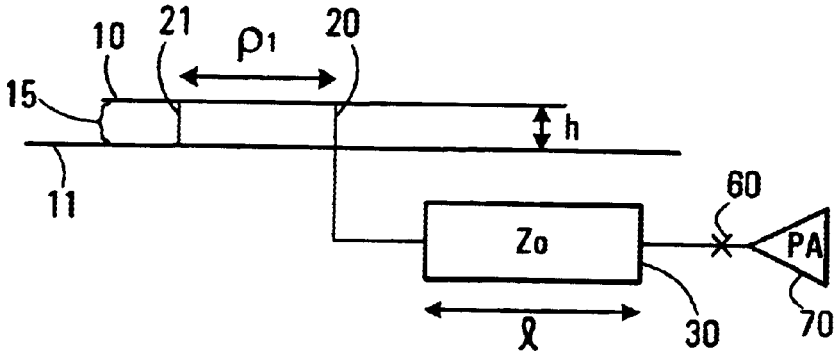
FIG. 1*a* is a schematic of the side view of a Planar inverted-F Antenna (PIFA) of the present invention.
Figure 1B:
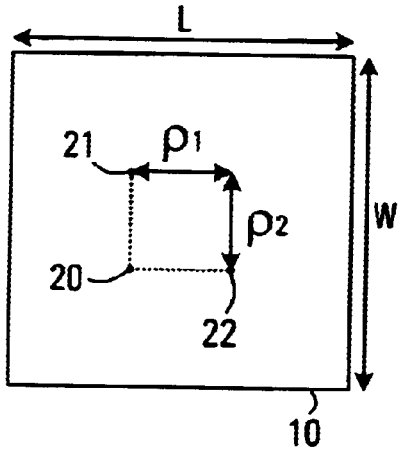
FIG. 1*b* is a schematic of the top view of the PIFA, of FIG. 1*a;*

FIGS. 1*a* and 1*b* illustrate schematic views of one embodiment of the invention. The planar inverted-F antenna serves as a radiating element comprising a top plate 10 a dielectric substance 15 with a dielectric constant (i.e. relative permittivity) $\in_r$, and a ground plane 11. The dielectric substance is a height h, where by the height defines the height of the planar inverted-F antenna. The ground plane 11 extends beyond the edges of the top plate to the extent that its electromagnetic characteristics allow it to be approximated as a ground plane that has infinite length and width. As such, the electromagnetic edge effects associated with a finite dimension ground plane can be ignored in the design process.

A feed pin 20 is connected to the underside of the top plate 10. A first shorting pin 21 and a second shorting pin 22 (not shown in FIG. 1*a*) are connected between the underside of the top plate 10 and the ground plane 11, such that an imaginary line between the feed pin 20 and shorting pins 21 and 22 forms a right angle whose sides are parallel to two respective sides the top plate 10. In FIG. 1*b* it can be seen that the shorting pins, 21 and 22, are a distance $\rho_2$ and $\rho_1$ from the feed pin 20. Preferably the distances $\rho_2$ and $\rho_1$ are equal.

Feed pin 20 is connected between the top plate 10 and a first end of a short length of transmission line 30 having characteristic impedance $Z_o$ and length. The transmission line 30 has a second end coupled to a power, amplifier (PA) 70 at terminal 60. Transmission line is used to fine-tune the input impedance of the radiating element for class-F and inverse class-F operation.

Figure 2:
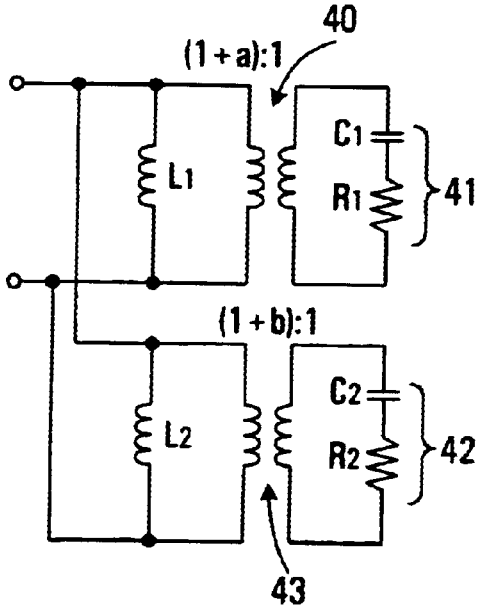
FIG. 2 is a schematic of the equivalent circuit model of the PIFA in FIGS. 1*a* and 1*b;*

The equivalent circuit model, shown in FIG. 2, allows one to model the operation of the planar inverted-F antenna having two shorting pins in a manner similar to that of a folded monopole type antenna. The difference being a greatly reduced foot print (i.e. Area occupied by the radiating element) and the option for wide ranges of tuning. The radiating element (antenna) mode is excited such that the feed pin 20 and the shorting pins 21 and 22 are driven in phase similar to the operation of a top-loaded monopole. A transverse mode is also excited such that currents between the feed pin 20 and the shorting pins 21 and 22 are out of phase and behave as shorted sections of transmission line. The inclusion of the second pin results in a second radiating element mode and a second transmission line mode. An inductor L1 and a second inductor L2 represent the shunt inductances due to the shorted transmission line modes. A transformer 40 and a second transformer 43 have turns ratios (1+a) and (1+b), respectively, that represent the current coupling between the feed pin 20 and the two shorting pins 21 and 22 for radiating element electromagnetic modes. A series RC circuit 41 and a second series RC circuit 42 represent the impedance of two top-loaded monopoles, respectively.

With reference to FIG. 1*b* the top plate 10 has dimensions of length L and width W. If the planar inverted-F antenna is designed as an optimum load at frequency $f_0$, then it is easily converted to operate at another frequency $f_1$, by scaling all of the aforementioned dimensions according to the following relations:

$$1)\quad h' = h\frac{f_0}{f_1}$$

$$2)\quad L' = L\frac{f_0}{f_1}$$

$$3)\quad W' = W\frac{f_0}{f_1}$$

$$4)\quad \rho' = \rho\frac{f_0}{f_1}$$

$$5)\quad l' = l\frac{f_0}{f_1}$$

In general, a method of tuning a planar inverted-F antenna with two shorting pins to realize a class-F impedance comprise the following steps:

1.a.) Varying the top plate position so that the feed pin 20 is located substantially near the center to provide a nearly class-F impedance at the frequency $f_0$. An additional effect of placing the top plate such that the feed pin 20 and shorting pins 21 and 22 are closer to the center of the top plate (zero-offset) is a greater bandwidth available for transmission of a signal.

2) Increasing or decreasing the distance ρ between the shorting pins 21 and 22 and the feed pin 20, to respectively increase or decrease the real part of the input impedance $Z_{in}$ of the planar inverted-F antenna. Thus the distance ρ is chosen to increase or decrease the input impedance $Z_{in}$ as required. It should also be noted that apart from the circular radiation pattern typical for vertically polarized antennas, the $E_\phi$field in the overhead position at position θ=0 increases as ρ increases. Also as ρ increases, the real part of the driving point impedance also increases for most frequencies However, increasing ρ also has the effect of increasing the resonant frequency of a characteristic impedance loop that can be seen on a Smith Chart (not shown).

3) Increasing or decreasing the height h of the top plate 10 above the ground plane 11 to respectively increase or decrease the real part of the planar inverted-F antenna's input impedance $Z_{in}$ at $f_0$, and also respectively reduce or increase the reactance (i.e. The imaginary part) of the planar inverted-F antenna's input impedance $Z_{in}$.

4) Adjusting the length l of the transmission line 30 to fine-tune the input impedance $Z_{in}$ of the planar inverted-F antenna. The short section of transmission line 30 can be used to fine-tune the input impedance at the operating frequency and maintain the desired harmonic loading at the second and third harmonics. To realize an inverse class-F load usually requires between 25% to 50% more transmission line length at the input to the planar inverted-F antenna than for the class-F load.

In the alternative the planar inverted-F antenna may be tuned to realize an inverse class-F impedance by replacing step 1.a.), from above, with 1.b.) as stated below:

1.b.) Varying the top plate position so that the feed pin 20 is located substantially close to a corner of the top plate 10 to provide a nearly inverse class-F impedance at a frequency $f_0$. In this case the $E_\phi$ field component (the electric field component in the azimuth direction relative to a perpendicular line from the surface of the radiating element) in the overhead direction is a maximum for the case of maximum offset where the feed pin 20 and shorting pins 21 and 22 are located a maximum distance from the center of the plate.

In conjunction with the tuning steps above choosing a type of dielectric material to be placed between the top plate 10 and ground plane 11 is also an optional design consideration. The type of dielectric used between the top plate and ground plane can reduce the required area for the top plate. Materials with higher dielectric constants, relative to free space, will reduce the area relative to the area required if free space is the dielectric substance. Materials with lower dielectric constants will have the opposite effect. The type of dielectric substance is also chosen specifically for the range of frequencies where it may be effective. Therefore, the dielectric substance is chosen considering the frequency of operation and constraints on the size of the radiating element.

Examples of the types of dielectric material that can be used are alumina, quartz, polytetra fluoroethylene, epoxy/glass and air. Preferably, alumina or quartz or polytetra fluoroethylene is used when the operating frequency is above 1 GHz. Preferably, epoxy/glass is used when the operating frequency is below 1 GHz. Other suitable dielectric materials for different applications would be obvious to those ordinarily skilled in the art.

Upon tuning the radiating element to operate at a frequency $f_0$, the radiating element can be scaled, as described above, to change the operating frequency of the radiating element to a new operating frequency $f_1$.

Figure 3A:
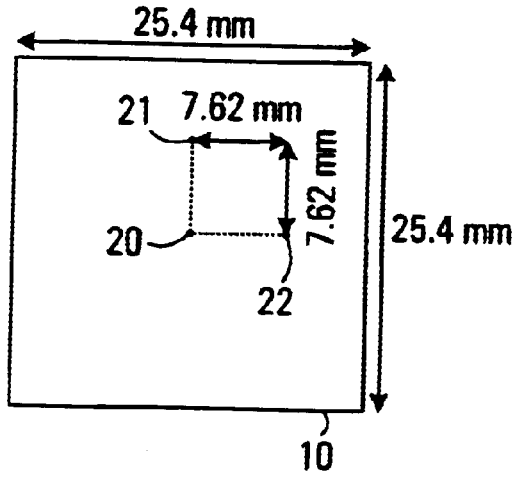
FIG. 3*a* is a schematic of the top view of a PIFA optimized to provide a class-F impedance load.
Figure 3B:
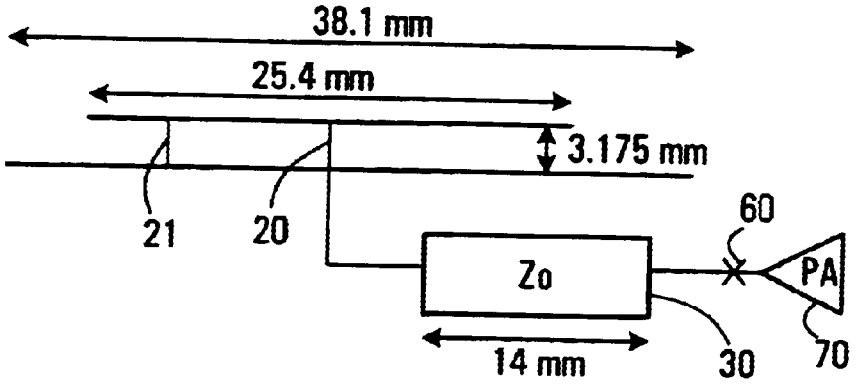
FIG. 3*b* is a schematic of the side view of the PIFA of FIG. 3*a;*

FIG. 3*a* is an illustration if the top view of the planar inverted-F antenna optimized for an input-impedance that is considered class-F at an operating frequency of $f_0$=2.7 GHz. The feed pin 20 is located at a central location within the perimeter of the top plate. FIG. 3*b* is a schematic of the side view of the same planar inverted-F antenna.

With reference to FIG. 3*a,* the height h of the planar inverted-F 10 is 3.175 mm and the top plate is square with dimensions L×W being 25.4 mm×25.4 mm. Each shorting pin 21 and 22 is located a distance ρ=7.62 mm placed so that they form a right angle with the feed pin 20 which is slightly offset from the center of the top plate. As per an assumption made earlier the ground plane extends past the edges of the top plate to approximate a infinite ground plane, and in this embodiment the dimension of the ground plane is 38.1 mm×38.1 mm.

Referring to FIG. 3*b,* it was found that for the planar inverted-F antenna to provide a precisely tuned class-F impedance at $f_0$=2.7 GHz it had to be connected in series with the transmission line 30 having a length of 14 mm, a dielectric constant of 2.2 and above a substrate 0.381 mm thick. That is, the transmission line is above a different dielectric material (not shown) serving as a substrate with dielectric constant $\in_r$=2.2, a thickness of 0.381 mm and metalized on the side opposite the transmission line (e.g. microstrip line). This arrangement is shown in FIG. 3*b;* and in reference to FIG. 3*b,* the planar inverted-F antenna 10 will have a class-F response when it is measured at terminal 60.

If, for example, it is required that the PIFA of FIGS. 3*a* and 3*b* must have its operating frequency be tuned to say $f_1$=1.8 GHz (a new operating frequency), then the scaling equations provided above would result in a new PIFA with the following dimensions: h=4.763 mm; L=38.1 mm; W=38.1 mm; ρ=11.43; Length of transmission line=21 mm. Note that the dielectric material between the top plate and the ground plane of both planar inverted-F antennas must be the same for the scaling according to the invention to work as intended.

The embodiment of the invention described in detail thus far was implemented using a rectangular top plate and two shorting pins placed around a feed pin to form a right angle. The imaginary lines of the right angle were parallel and perpendicular to respective sides of the rectangular top plate. However, the present invention is not limited to embodiments having a rectangular top plate or embodiments where the feed pin and the shorting pins form a right angle or substantially a right angle.

Any symmetric top plate defined by at least one line of symmetry across its broadest surface could be used in place of the rectangular top plate described above.

Furthermore, the two shorting pins need only be placed around the feed pin such that the distance to the feed pin from either shorting pin is substantially equal. In the embodiment described above it was found to be preferable to place the shorting pins around the feed pin such that a right angle was formed. Possibly, if the angle was greater than ninety degrees, the shorting pin spacing increase would possibly improve the bandwidth or the tunability of the radiating element. This may degrade the radiation pattern however, possibly decreasing the pattern in the overhead direction. Decreasing the pin angle would result in the shorting pins being closer and thus lowering the bandwidth of the radiating element.

Additionally, the imaginary lines of the angle formed by the shorting pins and feed pin would not necessarily have to be placed in any particular orientation in relation to the edges of the top plate. In the embodiment described above it was found to be preferable to have imaginary lines of the right angle formed by the shorting pins and feed pin be parallel and perpendicular to the edges of the rectangular top plate.

Another embodiment in accordance with the aspects of the invention is an offset top-loaded monopole tuned to provide an inverse class-F impedance. A top-loaded monopole is essentially a short monopole with a flat top plate. Thus, conceptually, a top-loaded monopole is obtained if shorting pins 21 and 22 are removed from the planar inverted-F antenna illustrated in FIGS. 1*a* and 1*b*.

The top-loaded monopole can be optimized for inverse class-F operation. However, the drawbacks of doing so are that the top plate must be much larger and a longer length of transmission line is required for the input impedance tuning. Additionally, the top-loaded monopole is limited, as it cannot be used to realize class-F impedances.

Despite these limitations, compared to the planar inverted-F antenna with two shorting pins, the top-loaded monopole can be tuned to realize inverse class-F impedances. In order to realize inverse class-F impedances the feed pin is offset from the center of the top plate so that is close to a corner of the top plate. Thus, it is a maximal distance away from the center. Accordingly, from herein, the top-loaded monopole used to realize inverse class-F impedances well be referred to as the offset top-loaded monopole.

For the top-loaded monopole, feeding the top plate closer to the edge results in a wider bandwidth as well as greater cross-polarization contribution in the overhead direction. This is the same phenomenon present in the planar inverted-F antenna with two shorting pins. For the case of a center-fed top-loaded monopole, there is no cross- or horizontally-polarized field at zero elevation above the surface of the radiating element. Offsetting the feed-pin, results in an asymmetric current distribution on the top plate resulting in the $E_\varphi$ field component in the top direction.

Figure 4A:
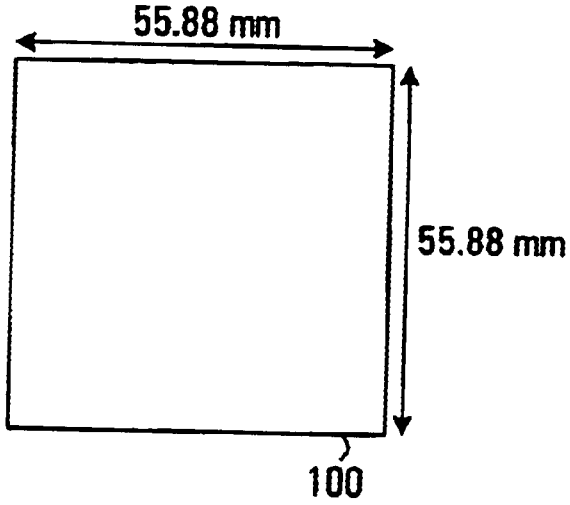
FIG. 4*a* is a schematic of the top view of an offset top-loaded monopole (TLM) optimized to provide an inverse class-F impedance.
Figure 4B:
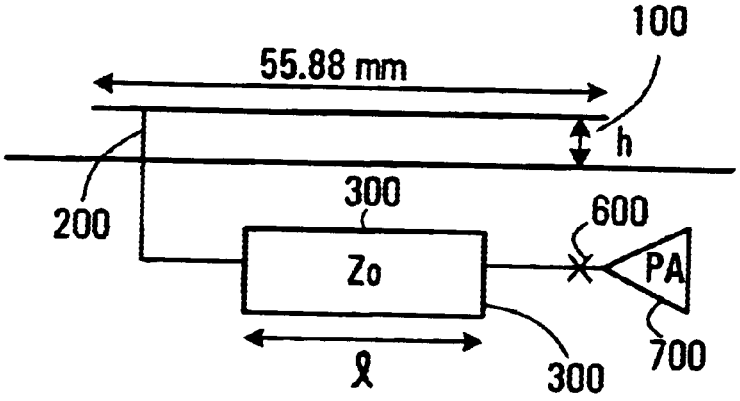
FIG. 4*b* is a schematic of the side view of the offset-TLM of FIG. 4*a*.

FIGS. 4*a* and 4*b* illustrate the top view and side view of the offset TLM optimized to operate at 2.2 GHz respectively. A top plate 100 is placed at a height h over a ground plane. The dimensions of the top plate are 55.88 mm×55.88 mm, and the required length of transmission line used to fine tune the offset-TLM is 25 mm. There are no shorting pins and only a single feed pin 200. The lack of the shorting pins causes significant increases in the area of the top plate and length of the transmission line. Note that the fed, pin 200 is near the corner of the top plate so that the input impedance to this radiating element is approximately that of an inverse class-F impedance.

The embodiment of the invention described in detail thus far was implemented using a rectangular top plate and a feed pin placed in substantially near a corner. However, the present invention is not limited to embodiments having a rectangular top plate or embodiments where the feed pin in placed substantially near a corner of the top plate.

Any symmetric top plate defined by at least one line of symmetry across its broadest surface could be used in place if the rectangular top plate described above.

Additionally the feed pin can be placed substantially close to an edge of the top plate instead of substantially close to a corner of the top plate. In the embodiment described above it was found to be preferable to have the feed pin substantially close to a corner.

In both configurations, the planar inverted-F antenna and offset top-loaded monopole have a large co-polarized electromagnetic field component in the azimuth plane and a cross-polarized filed component in the elevation plane. For each of the radiating element configurations, scaling can be used to tune the radiating element to a different frequency once the radiating element has been designed for a first frequency of operation.

The inverse class-F planar inverted-F antenna radiating structures are smaller than the corresponding offset top-loaded monopole structures. Additionally they both greatly simplified the power amplifier design by in effect allowing a single power amplifier to be considered broadband by eliminating a lumped passive electrical element network between the power amplifier and the radiating element and simply scaling the radiating element for use at different frequencies.

For both the planar inverted-F antenna and offset top loaded monopole there may be instances where a low enough input impedance $Z_{in}$ to the radiating element is sought such that the desired impedance can be obtained directly at the feed pin without the use of a transmission line. In this case, the transmission line has zero length.

What has been described is merely illustrative of the application of the principles of the invention. Other arrangements and methods can be implemented by those skilled in the art without departing from the spirit and scope of the present invention.

We claim:

1. A Planar inverted-F Antenna (PIFA) comprising:

a top plate, a ground plane, a dielectric material between the top plate and the ground plane, and a feed pin connected to the top plate somewhere within the top plate's interior area;

a first shorting pin and a second shorting pin, the first and second shorting pins connecting the top plate somewhere within the top plate's interior area and to the ground plane and the first and second shorting pins located at distances $\rho_1$ and $\rho_2$, respectively, from the feed pin to provide a desired impedance of the PIFA at the feed pin.

2. The PIFA of claim 1, wherein the feed pin is connected to a first end of a transmission line, the transmission line being used for fine-tuning of the PIFA.

3. The PIFA of claim 1, wherein a second end of the transmission line is connected to a power amplifier.

4. The PIFA of claim 1, whereby a power amplifier is connected to the feed pin.

5. The PIFA of claim 4, wherein the power amplifier is a broadband power amplifier.

6. The PIFA of claim 1, wherein $\rho_1$ and $\rho_2$ are substantially equal.

7. The PIFA of claim 1, wherein the top plate is rectangular.

8. The PIFA of claim 1, wherein an imaginary line between the feed pin and the shorting pins forms substantially a right angle.

9. The PIFA of claim 1, wherein the dielectric material is air.

10. The PIFA of claim 1, wherein the dielectric material is epoxy/glass.

11. The PIFA of claim 1, wherein the dielectric material is alumina.

12. The PIFA of claim 1, wherein the dielectric material is quartz.

13. The PIFA of claim 1, wherein the dielectric material is polytetra fluoroethylene.

14. The PIFA of claim 1 tuned at an operating frequency $f_0$ and providing a class-F load impedance.

15. The PIFA of claim 1 tuned at an operating frequency $f_0$ and providing an inverse class-F load impedance.

16. A method of tuning a planar inverted-F antenna (PIFA) to operate at an operating frequency $f_0$ and to provide a class-F impedance, the PIFA having a top plate, a ground plane, a feed pin, a transmission line connected to the feed pin, a first shorting pin and a second shorting pin, the shorting pins connecting the top plate to the ground plane, the method comprising the steps of:

a) varying the position of the top plate to locate the feed pin at or near the center of the top plate;

b) varying the distance $\rho$ between the first and second shorting pins and the feed pin, thereby changing the real part of the input impedance of the PIFA;

c) varying the height of the top plate above the ground plane to change the real part of the input impedance of the PIFA, while respectively changing the imaginary part of the input impedance of the PIFA; and d) adjusting the length of the transmission line to fine tune the input impedance of the PIFA at $f_0$ and to maintain the desired harmonic loading at the second and third harmonics of $f_0$.

17. A method of tuning a planar inverted-F antenna (PIFA) to operate at an operating frequency $f_0$ and to provide a inverse class-F impedance, the PIFA having a top plate, a ground plane, a feed pin, a transmission line connected to the feed pin, a first shorting pin and a second shorting pin, the shorting pins connecting the top plate to the ground plane, the method comprising the steps of:

a) varying the top plate position so that the feed pin is a maximal distance away from the center of the top plate;

b) varying the distance $\rho$ between the first and second shorting pins and the feed pin thereby changing the real part of the input impedance of the PIFA;

c) varying the height of the top plate above the ground plane to change the real part of the input impedance of the PIFA, while respectively changing the imaginary part of the input impedance of the PIFA; and d) adjusting the length of the transmission line to fine tune the input impedance of the PIFA at $f_0$ and to maintain the desired harmonic loading at the second and third harmonics of $f_0$.

18. A method of tuning a planar inverted-F antenna (PIFA) from a first operating frequency $f_0$ to a second operating frequency $f_1$, the PIFA having a top plate, a ground plane, a feed pin, a transmission line connected to the feed pin, a first shorting pin and a second shorting pin, the shorting pins connecting the top plate to the ground plane, the method comprising the steps of:

a) scaling the height of the top plate above the ground plane by a factor of $f_0/f_1$;

b) scaling $\rho$ by a factor of $f_0/f_1$;

c) scaling the area of the top plate by a factor of $(f_0/f_1)^2$; and d) scaling the length of the transmission line by a factor of $f_0/f_1$.

19. A planar inverted-F antenna (PIFA) comprising of:

a rectangular top-plate, having a dimension L and a dimension W, a ground plane having dimensions larger than those of the top-plate, and a dielectric material between the top-plate and ground plane;

a feed pin connected to the top-plate somewhere within the top-plate's interior area;

a first shorting pin and a second shorting pin connected between, and to, the top-plate and ground plane, such that the feed pin and two shorting pins form substantially a right angle whose edges are substantially perpendicular and parallel to an edge of the top-plate, and such that each shorting pin is a distance $\rho$ from the feed pin; and a length of transmission line connected to the end of the feed pin that is not connected to the top-plate.

20. A communication device comprising:

a planar inverted-F antenna (PIFA) having a top plate, a ground plane, and a feed pin connected to the top plate somewhere within the top plate's interior area, a first shorting pin and a second shorting pin, the first and second shorting pins connecting to the top plate somewhere within the top plate's interior area and to the ground plane;

a power amplifier; and a transmission line connecting the feed pin to the power amplifier.

21. An offset top loaded monopole (TLM) tuned for an operating frequency $f_0$ and providing an inverse class-F load impedance, the TLM comprising;

a top plate, a ground plane, a dielectric material between the top plate and the ground plane and a feed pin connected to the top plate substantially offset from the centre of the top plate somewhere within the top plate's interior area to provide a desired impedance of the offset TLM at the feed pin.

22. The offset TLM of claim 21, wherein the feed pin is connected to a transmission line, the transmission line being used for fine-tuning of the offset TLM.

23. The offset TLM of claim 22, wherein the transmission line is connected to a power amplifier.

24. The offset TLM of claim 21, wherein a power amplifier is connected to the feed pin.

25. The offset TLM of claim 23, wherein the power amplifier is a broadband power amplifier.

26. The offset TLM of claim 21, wherein the dielectric material is air.

27. The offset TLM of claim 21, wherein the dielectric material is epoxy/glass.

28. The offset TLM of claim 21, wherein the dielectric material is alumina.

29. The offset TLM of claim 21, wherein the dielectric material is quartz.

30. The offset TLM of claim 21, wherein the dielectric material is polytetra fluoroethylene.

31. A method of tuning an offset top loaded monopole (TLM) to operate at an operating frequency $f_0$ and to provide a inverse class-F impedance, the offset TLM having a top plate, a ground plane, a feed pin, a transmission line connected to the feed pin, the method comprising the steps of:

a) varying the top plate position so that the feed pin is a maximal distance away from the center of the top plate;

b) varying the height of the top plate above the ground plane to change the real part of the input impedance of the offset TLM, while respectively changing the imaginary part of the input impedance of the offset TLM; and c) adjusting the length of the transmission line to fine tune the input impedance of the offset TLM at $f_0$ and to maintain the desired harmonic loading at the second and third harmonics of $f_0$.

32. A method of tuning an offset top loaded monopole (TLM) from a first operating frequency $f_0$ to a second operating frequency $f_1$, the offset TLM having a top plate, a ground plane, a feed pin, a transmission line connected to the feed pin, the method comprising the steps of:

a) scaling the height of the top plate above the ground plane by a factor of $f_0/f_1$;

b) scaling the area of the top plate by a factor of $(f_0/f_1)^2$; and c) scaling the length of the transmission line by a factor of $f_0/f_1$.

* * * * *

UNITED STATES PATENT AND TRADEMARK OFFICE

CERTIFICATE OF CORRECTION

PATENT NO. : 6,744,409 B2
DATED : June 1, 2004
INVENTOR(S) : Grant A. Ellis

It is certified that error appears in the above-identified patent and that said Letters Patent is hereby corrected as shown below:

Column 8,
Line 19, please add the folllowing sentence after "… a single feed pin 200."
-- The feed pin 200 is connected between the top plate 100 and a first end of a short length of transmission line 300, similar to the transmission line 30 shown in Figures 1A and 3B. --

Column 9,
Line 8, "… shorting pins connecting…" should be -- … shorting pins directly connecting… --
Line 17, change "… of claim 1, wherein…" to -- … of claim 2, wherein… --

Signed and Sealed this

Sixteenth Day of November, 2004

JON W. DUDAS
*Director of the United States Patent and Trademark Office*